US008870364B2

(12) United States Patent
Miyashita et al.

(10) Patent No.: US 8,870,364 B2
(45) Date of Patent: Oct. 28, 2014

(54) PRINTER APPARATUS AND ROLLER ASSEMBLY

(75) Inventors: Eiji Miyashita, Nagano (JP); Masanori Takada, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 119 days.

(21) Appl. No.: 13/395,123

(22) PCT Filed: Sep. 8, 2010

(86) PCT No.: PCT/JP2010/005502

§ 371 (c)(1),
(2), (4) Date: Mar. 9, 2012

(87) PCT Pub. No.: WO2011/030543

PCT Pub. Date: Mar. 17, 2011

(65) Prior Publication Data

US 2012/0169804 A1 Jul. 5, 2012

(30) Foreign Application Priority Data

Sep. 11, 2009 (JP) ..... 2009-210359

(51) Int. Cl.
*B41J 2/01* (2006.01)

(52) U.S. Cl.
USPC ..... 347/104; 347/5; 347/36

(58) Field of Classification Search
USPC ..... 347/5, 9, 16, 36, 104
See application file for complete search history.

(56) References Cited

U.S. PATENT DOCUMENTS 6,523,933 B1 * 2/2003 Hirano et al. ..... 347/36
8,136,937 B2 * 3/2012 Yoshida ..... 347/104

FOREIGN PATENT DOCUMENTS

| | | |
|---|---|---|
| JP | 08-012122 | 1/1996 |
| JP | 2002-301842 | 10/2002 |
| JP | 2006-198875 | 8/2006 |
| JP | 2008-030900 | 2/2008 |
| WO | 2007026471 | 3/2007 |

OTHER PUBLICATIONS

"1st Office Action of China Counterpart Application", with English translation thereof, issued on Dec. 20, 2013, P1-P15, in which the listed reference was cited.

* cited by examiner

*Primary Examiner* — Lam S Nguyen
(74) *Attorney, Agent, or Firm* — Jianq Chyun IP Office

(57) ABSTRACT

A printer apparatus in the present invention includes a feeding mechanism having a feed roller provided at substantially the same height as an upper face of a medium support means and a plurality of roller assemblies having a pinch roller disposed above the feed roller and a printing medium placed on the medium support means is pinched between the feed roller and the pinch roller to be fed in the front and rear direction. The roller assembly is structured of an assembly main body and a roller member which includes the pinch roller and is attachable/detachable with respect to the assembly main body, and a clamp state can be changed by exchanging the roller member depending on material and/or thickness of the printing medium.

6 Claims, 10 Drawing Sheets

PRINTER APPARATUS AND ROLLER ASSEMBLY

CROSS-REFERENCE TO RELATED APPLICATION

This application is a 371 of international application of PCT application serial no. PCT/JP2010/005502, filed on Sep. 8, 2010, which claims the priority benefit of Japan application no. 2009-210359, filed on Sep. 11, 2009. The entirety of each of the above-mentioned patent applications is hereby incorporated by reference herein and made a part of this specification.

TECHNICAL FIELD

The present invention relates to a printer apparatus in which printing is performed on a printing medium by ejecting ink from a printer head. More specifically, the present invention relates to a printer apparatus which is capable of performing printing on a sheet-like printing medium and a plate-like printing medium, and a roller assembly which is used in the printer apparatus.

BACKGROUND ART

A printer apparatus (inkjet printer) has been conventionally known in which printing is performed on a printing medium formed in a sheet-like shape (hereinafter, referred to as a sheet-like medium) by executing control for feeding the printing medium in the front and rear direction with respect to a platen and control for ejecting ink while moving a printer head facing the platen in the right and left direction in a combined manner.

In recent years, it is required that printing is performed on a printing medium formed in a plate-like shape (hereinafter, referred to as a plate-like medium) in addition to a sheet-like medium by using the printer apparatus. In order to attain this requirement, a structure has been known in which, for example, support members for horizontally supporting a plate-like medium are provided on the front and rear sides of the platen. According to this structure, a plate-like medium is capable of being fed in the front and rear direction while being supported horizontally and printing is performed on the plate-like medium.

For example, in FIG. 3 in Patent Literature 1, a structure is disclosed in which a first support arm 101 and a second support arm 103 are provided on the front and rear sides of a platen 10 to horizontally support a plate-like medium 20 and the plate-like medium 20 is moved in the front and rear direction by rotating a feed roller 15. In the structure shown in FIG. 3 in Patent Literature 1, a plate-like medium 20 is moved in the front and rear direction while the under face of the plate-like medium 20 is slid on the upper face of the platen 10 by rotating the feed roller 15.

In the printer apparatus, it is important that a printing medium which is pinched between a feed roller and a pinch roller is fed with an accurate feeding amount which is proportional to a rotation angle of the feed roller for securing printing quality. Therefore, in order to prevent a printing medium from partially slipping on the feed roller, a number of roller assemblies respectively having a rotatable pinch roller is provided above the feed roller with a predetermined interval in the right and left direction.

Some of the roller assemblies are structured so that a clamp state for a printing medium can be changed. For example, a roller assembly has been known which includes a clamp pressure setting mechanism by which a pressing force (referred to as a clamp pressure) of a pinch roller that is pressed against the feed roller is capable of being changed and set depending on material, thickness and the like of a printing medium.

RELATED ART DOCUMENTS

Patent Documents

Patent Document 1: Japanese Patent Laid-Open No. 2002-301842

DISCLOSURE OF INVENTION

Problem to be Solved by the Invention

In recent years, it is desired that printing is performed on a large-scale plate-like medium (for example, a width in the right and left direction is about 1 m and a length in the front and rear direction is about 1.6 m).

However, in the conventional device as described above, whenever a clamp state is to be changed depending on a type of a medium, an operator is required to perform a switching operation of a corresponding lever.

Further, in a multi-function apparatus which is capable of finely adjusting and setting of a clamp state depending on material, shape, size, thickness, a printing range and the like of a printing medium, a clamp engage and disengage mechanism, a clamp pressure setting mechanism and the like are independently provided in each of roller assemblies and a clamp pressure is capable of being set at a plurality of levels (for example, three levels of strong, medium and weak). Therefore, in a case that sheet-like media whose material, shape, dimension and the like are different from each other are to be worked, lever operations are respectively required in which a clamp lever and a clamp pressure setting lever are adjusted for each of a number of roller assemblies for each of objects to be worked. As a result, a setting operation is complicated even though a multifunctional property capable of performing a fine adjustment is provided.

In view of the problem described above, an objective of the present invention is to provide a printer apparatus and a roller assembly which are capable of suitably clamping a printing medium of various types of material/thickness, for example, a sheet-like medium and a plate-like medium, with a simple structure, and are capable of feeding the printing medium accurately.

Means for Solving the Problems

The printer apparatus described in the first exemplary embodiment of the present invention is: a printer apparatus in which printing is performed on a printing medium by ejecting ink while a printer head is relatively moved in a feeding direction and a scanning direction perpendicular to each other in a faced state with respect to the printing medium supported by a medium support means for supporting the printing medium, comprising: a feeding mechanism which includes a feed roller that is extended in a right and left direction at a height position the same as an upper face of the medium support means and is rotationally driven, and a plurality of roller assemblies in which rotatable pinch rollers are juxtaposedly disposed in the right and left direction on an upper side of the feed roller, and the feeding mechanism pinching the printing medium placed on the medium support means between the feed roller and the pinch rollers to feed the printing medium in a front and rear direction; a head moving mechanism for moving the printer head in the scanning direction; and a print control section for executing feed control of the printing medium by the medium feeding mechanism and movement control of the printer head by the head moving mechanism; wherein the roller assembly is structured of an assembly main body and a roller member which includes the pinch roller and is attachable/detachable with respect to the assembly main body; and wherein a clamp state can be changed by exchanging the roller member depending on material and/or thickness of the printing medium.

The printer apparatus described in the second exemplary embodiment of the present invention is: the printer apparatus according to the first exemplary embodiment of the present invention, wherein, in a case that the printing medium is a sheet-like medium, the roller member includes one pinch roller.

The printer apparatus described in the third exemplary embodiment of the present invention is: the printer apparatus according to the first exemplary embodiment of the present invention, wherein, in a case that the printing medium is a plate-like medium, the roller member includes a plurality of the pinch rollers having a relatively small diameter compared with a case that the printing medium is a sheet-like medium and disposed in a separated manner in the right and left direction.

A roller assembly described in the fourth exemplary embodiment of the present invention is: a roller assembly used in a printer apparatus in which printing is performed on a printing medium by ejecting ink while a printer head is relatively moved in a feeding direction and a scanning direction perpendicular to each other in a faced state with respect to the printing medium supported by a medium support means for supporting the printing medium, comprising: an assembly main body; and a roller member which includes a rotatable pinch roller and is attachable/detachable with respect to the assembly main body; wherein a clamp state can be changed by exchanging the roller member depending on material and/or thickness of the printing medium.

The roller assembly described in the first exemplary embodiment of the present invention is: the roller assembly according to the fourth exemplary embodiment of the present invention, wherein, in a case that the printing medium is a sheet-like medium, the roller member includes one pinch roller.

The roller assembly described in the sixth exemplary embodiment of the present invention is: the roller assembly according to the fourth exemplary embodiment of the present invention, wherein, in a case that the printing medium is a plate-like medium, the roller member includes a plurality of the pinch rollers having a relatively small diameter compared with a case that the printing medium is a sheet-like medium and disposed in a separated manner in the right and left direction.

Advantages of the Invention

In the printer apparatus and the roller assembly in accordance with the present invention, the roller member is exchanged depending on material and/or thickness of a printing medium to change a clamp state. Therefore, a printing medium of various types of material/thickness can be suitably clamped with a simple structure. Accordingly, in the present invention, a printer apparatus and a roller assembly are provided which are capable of accurately feeding depending on a printing medium of various types of material/thickness, for example, a sheet-like medium and a plate-like medium.

BEST MODE(S) FOR CARRYING OUT THE INVENTION

Figure 1:
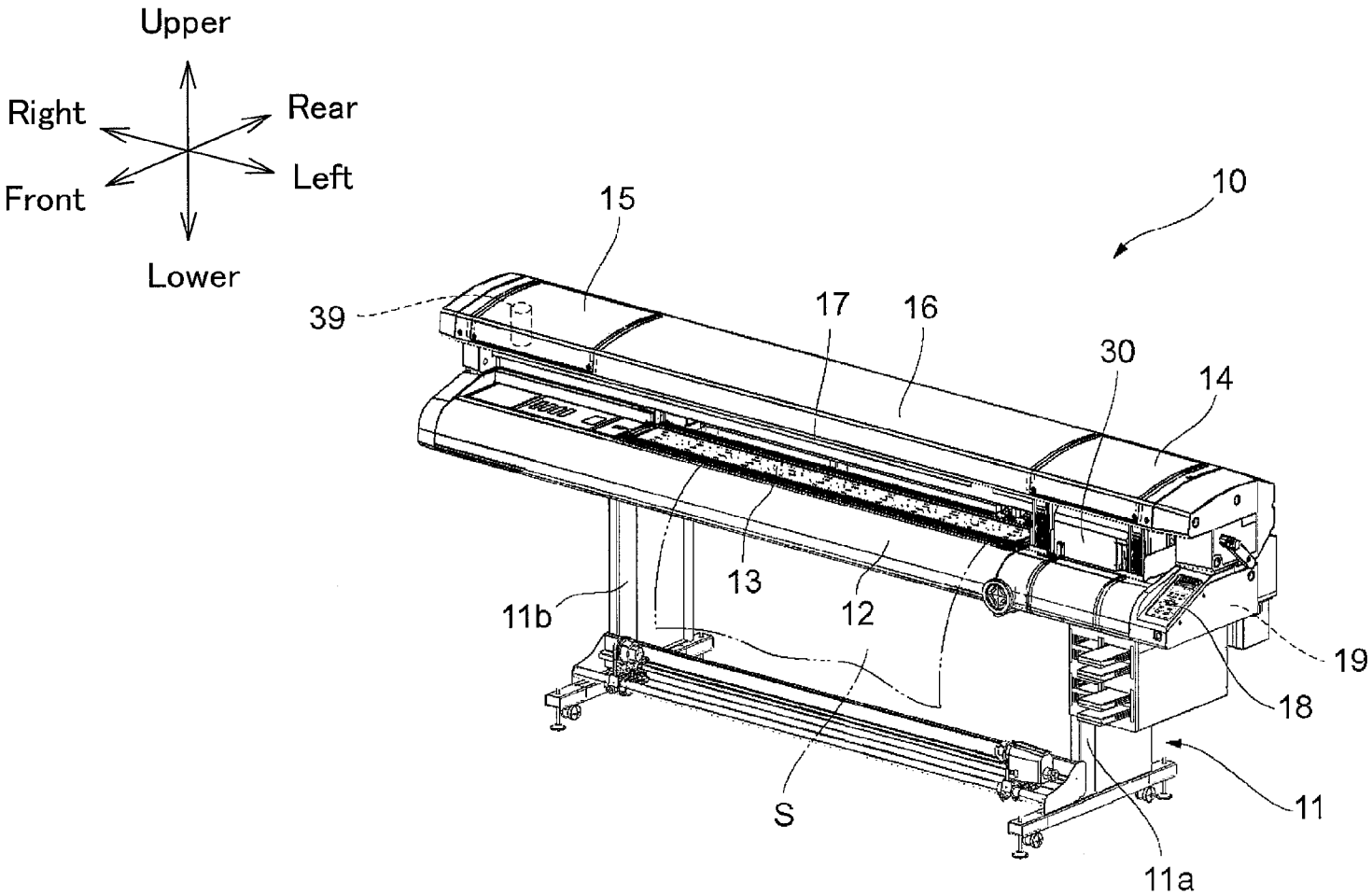
FIG. 1 is a perspective view showing a printer apparatus (a state in which printing is performed on a sheet-like medium) to which the present invention is applied.

A preferred embodiment of the present invention will be described below with reference to the accompanying drawings. In the following description, directions in the drawings indicated by the arrows are respectively defined as front and rear, right and left, and upper and lower for convenience of description.

FIG. 1 is a view showing an example of a structure of a printer apparatus in accordance with the present invention.

The printer apparatus in accordance with the present invention is a printer apparatus in which printing is performed on a printing medium by ejecting ink while a printer head is relatively moved in a feeding direction and a scanning direction perpendicular to each other in a faced state with respect to the printing medium supported by a medium support means for supporting a printing medium.

The printer apparatus includes a feeding mechanism, which is provided with a feed roller provided so as to be rotationally driven and extend in the right and left direction at a height position substantially the same as an upper face of a medium support means and a plurality of roller assemblies in which rotatable pinch rollers are provided side by side in the right and left direction above the feed roller for feeding a printing medium placed on the medium support means in the front and rear direction in a state that the printing medium is pinched between the feed roller and the pinch rollers, a head moving mechanism for moving the printer head in the scanning direction, and a print control section which executes feed control of a printing medium by using the medium feeding mechanism and movement control of the printer head by using the head moving mechanism.

The printer apparatus in accordance with the present invention is characterized in that the roller assembly is structured of an assembly main body and a roller member which includes the pinch roller and is capable of attaching/detaching to/from the assembly main body, and a clamp state is capable of being changed by exchanging the roller member depending on material and/or thickness of the printing medium. According to the printer apparatus in accordance with the present invention, a clamp state can be changed by exchanging the roller member in the roller assembly depending on material and/or thickness of the printing medium. Therefore, printing media having various types of material/thickness are suitably clamped with a simple structure. Accordingly, the printer apparatus in accordance with the present invention is capable of accurately feeding printing media having various types of material/thickness, for example, a sheet-like medium and a plate-like medium.

Figure 3:
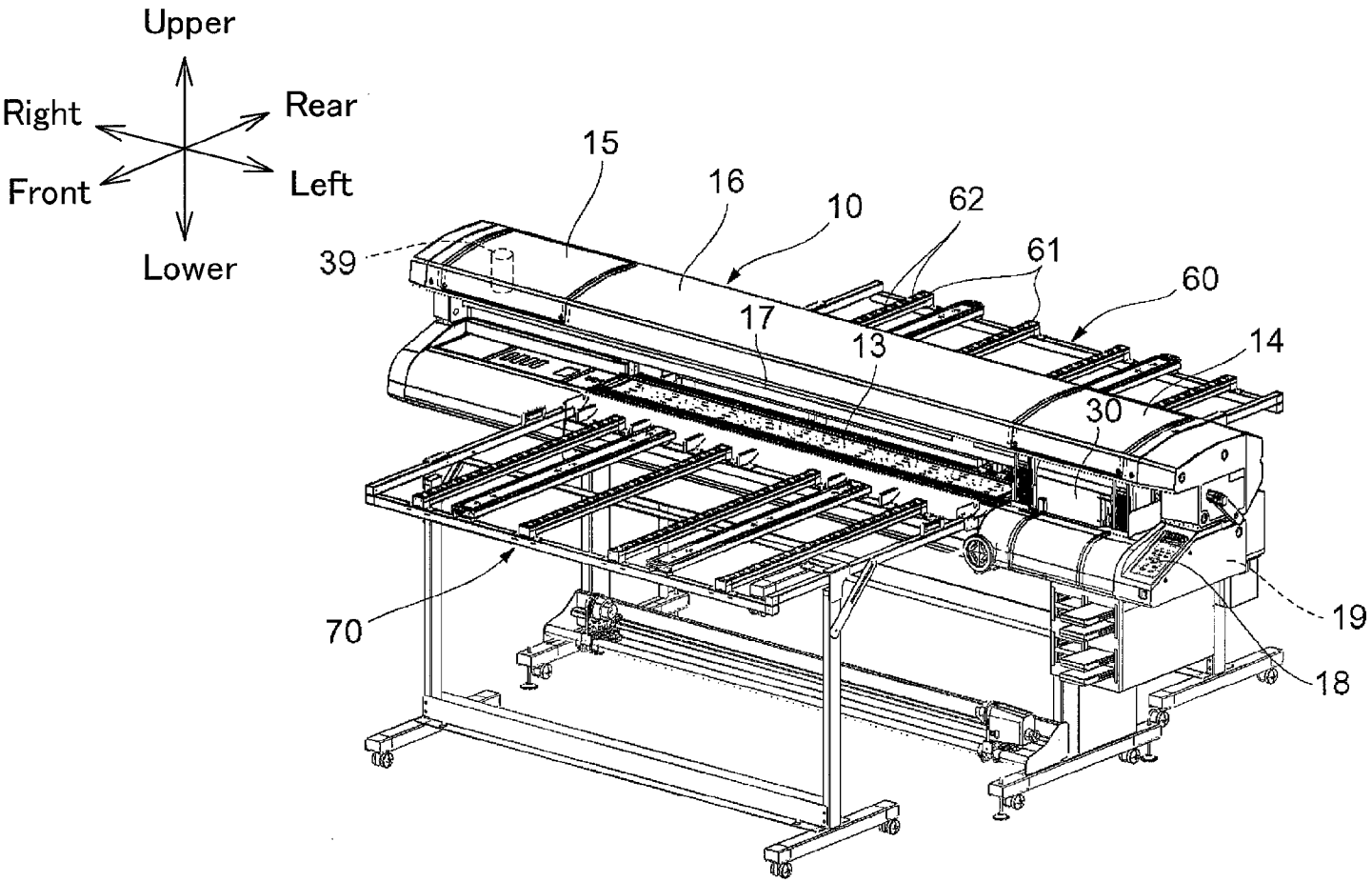
FIG. 3 is a perspective view showing the printer apparatus (a state in which printing is performed on a plate-like medium) which is viewed in an obliquely front side.
Figure 4:
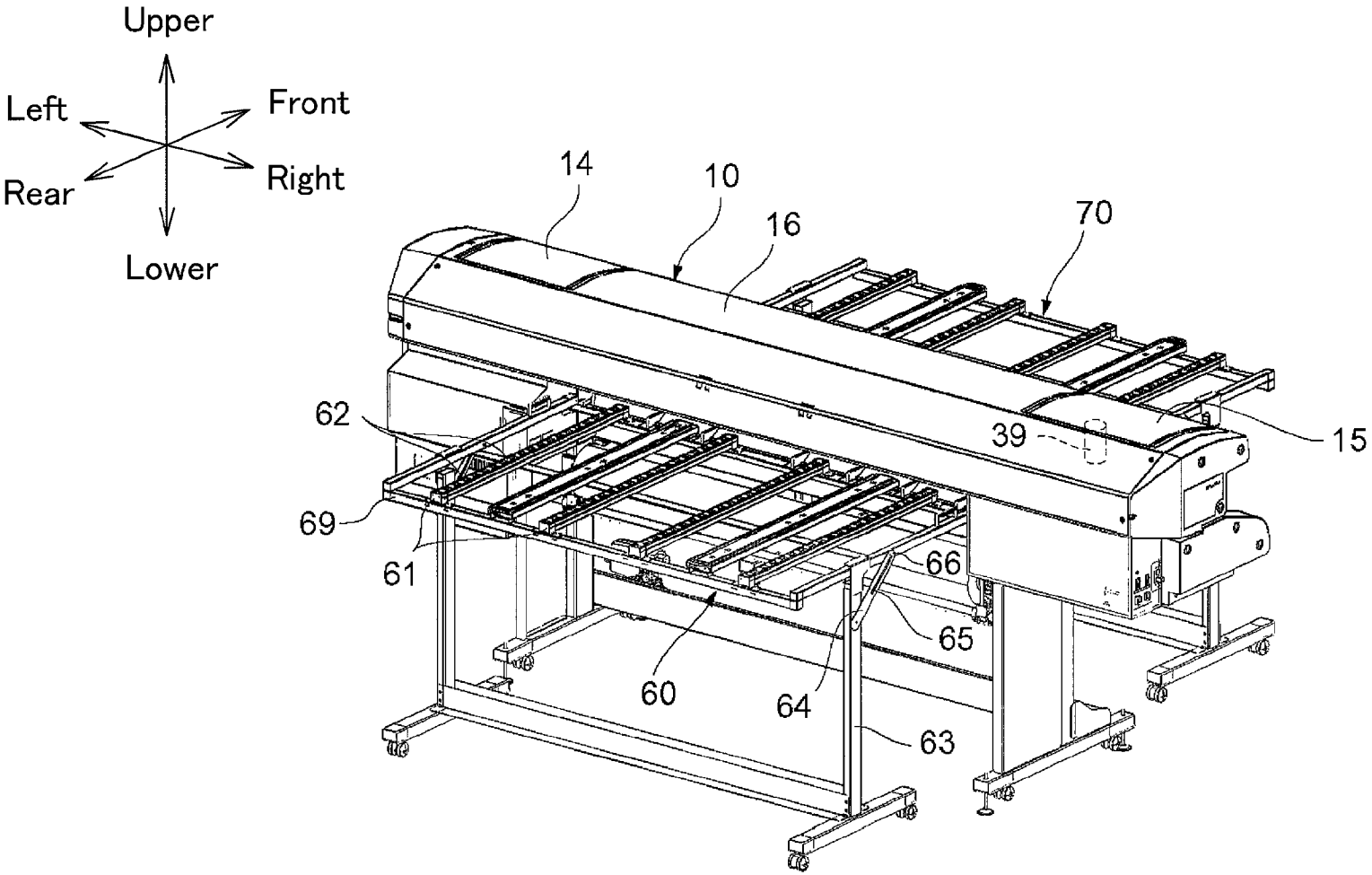
FIG. 4 is a perspective view showing the printer apparatus (a state in which printing is performed on a plate-like medium) which is viewed in an obliquely rear side.

A structure of a printer apparatus 10 to which the present invention is applied will be described below with reference to FIGS. 1 through 4. The printer apparatus 10 is originally structured as shown in FIG. 1 and printing can be performed on a sheet-like medium "S" by using the structure. On the other hand, when printing is to be performed on a plate-like medium, as shown in FIGS. 3 and 4, a rear side support base 60 and a front side support base 70 described below are attached to the printer apparatus 10. As described above, the printer apparatus 10 is capable of printing on both of a sheet-like medium "S" and a plate-like medium. In the following descriptions, a structure will be described as an example in which printing is performed by using ultraviolet curing type ink (hereinafter, referred to as "UV" ink) which is cured by irradiating ultraviolet rays.

The printer apparatus 10 is, as shown in FIG. 1, structured of a support leg 11 having right and left support legs 11*a* and 11*b*, a center body part 12 supported by the support leg 11, a left body part 14 provided on a left side of the center body part 12, a right body part 15 provided on a right side of the center body part 12, and an upper body part 16 which connects the right and left body parts 14 and 15 with each other and is extended on an upper side of the center body part 12 in a separated manner so as to be parallel to the center body part 12. The center body part 12 is provided with a flat plate-shaped platen 13 which is extended in the right and left direction so as to be exposed on its upper face. An operation part 18 which is structured of operation switches, display devices and the like is provided on a front face side of the left end part of the center body part 12.

A controller 19 is incorporated into a left end part of the center body part 12. The controller 19 outputs an operation signal to respective structure parts described below of the printer apparatus 10 to execute drive and control of the respective structure parts. Specifically, the controller 19 executes drive and control of a vertically moving mechanism (not shown) described below, a front and rear drive motor 25, printer heads 32, a right ultraviolet irradiation device 33R, a left ultraviolet irradiation device 33L, a right and left drive motor 39 and the like. A guide rail 17 extended in the right and left direction is provided on a front face side of a lower part of the upper body part 16. A printing unit 30 is attached to the guide rail 17 so as to be movable in the right and left direction.

Figure 2:
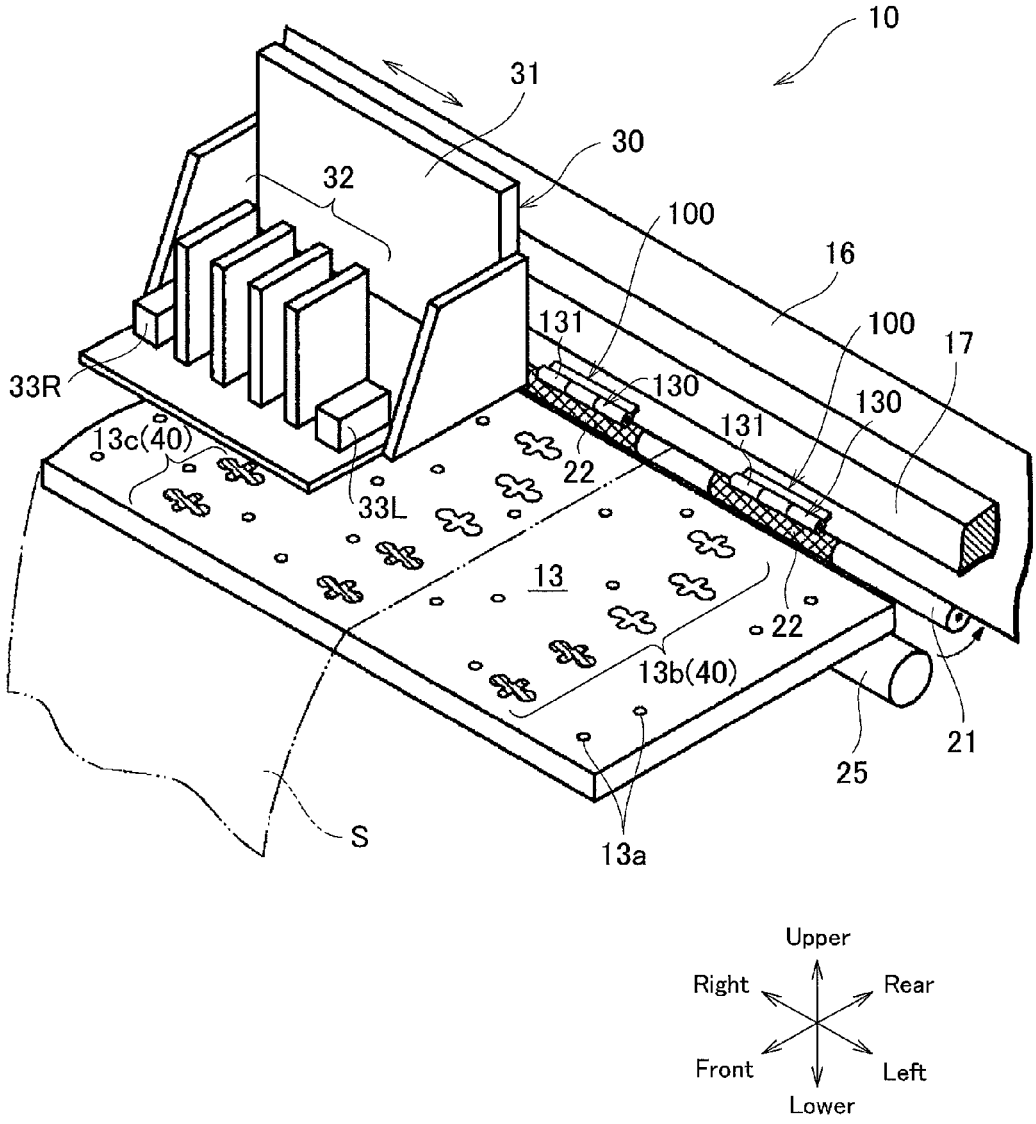
FIG. 2 is a perspective view showing a portion near a printing unit of the printer apparatus.

A printing unit 30 is, as shown in FIG. 2, mainly structured of a carriage 31, the printer heads 32, the right ultraviolet irradiation device 33R and the left ultraviolet irradiation device 33L. The printing unit 30 includes a vertically moving mechanism (not shown) which vertically moves the printing unit 30, for example, with respect to the guide rail 17 depending on thickness of a printing medium (sheet-like medium "S" or plate-like medium "B") that is an object to be printed. A space between the printer heads 32 and a printing medium can be set by the vertically moving mechanism in a predetermined distance suitable to perform printing irrespective of the thickness of the printing medium to be used.

In order to move the printing unit 30 in a reciprocated manner along the guide rail 17 in the right and left direction, a mechanism may be used in which, for example, a right and left carrying belt (not shown) arranged in the inside of the upper body part 16 so as to be extended in the right and left direction and the carriage 31 are connected with each other and the right and left carrying belt is driven by the right and left drive motor 39 provided in the right body part 15 (see FIG. 1). A rear face side of the carriage 31 is fitted to the guide rail 17 and the carriage 31 is capable of moving in a reciprocated manner along the guide rail 17 in the right and left direction. Further, the carriage 31 is also used as a mounting base for the printer heads 32, the right ultraviolet irradiation device 33R and the left ultraviolet irradiation device 33L.

The printer heads 32 are, for example, structured of a Magenta head, a Yellow head, a Cyan head and a Black head. A plurality of ejection nozzles (not shown) for ejecting "UV" ink toward a lower side is formed on an under face of each of the printer heads 32. The right ultraviolet irradiation device 33R is adjacently mounted on the right side of the printer heads 32. The right ultraviolet irradiation device 33R is mounted in its inside with a light source such as an LED which irradiates ultraviolet rays so that the ultraviolet rays are irradiated from the light source toward the lower side. The left ultraviolet irradiation device 33L is provided with the same structure as the right ultraviolet irradiation device 33R and is adjacently mounted on the left side of the printer heads 32. The "UV" ink ejected from the printer head 32 and stuck to a printing medium is surely cured by the ultraviolet rays irradiated from the right ultraviolet irradiation device 33R and the left ultraviolet irradiation device 33L.

As shown in FIG. 2, a plurality of roller assemblies 100 is attached to a lower part of the upper body part 16 side by side in the right and left direction. A pinch roller 131 is rotationally attached to a tip end part on the front side of the roller assembly 100. A feed roller 21 in a cylindrical tube shape which is extended in the right and left direction is disposed on the lower side of the pinch roller 131 so as to protrude with respect to the upper face of the platen 13. The feed roller 21 is driven and rotated by a front and rear drive motor (not shown) which is, for example, provided in the inside of the center body part 12.

The roller assembly 100 is capable of setting at a clamp position where the pinch roller 131 is pressed against the feed roller 21 and at an unclamp position where the pinch roller 131 is separated from the feed roller 21. According to this structure, in a state that the clamp device 23 is set at the clamp position so that a printing medium is pinched between the pinch roller 131 and the feed roller 21, when the feed roller 21 is rotated, the printing medium is fed to the front side or the rear side by a predetermined distance.

An abutting portion of a surface of the feed roller 21 with the pinch roller 131 is, for example, stuck and fixed with a metal mesh member 22. According to this structure, a contact resistance of the feed roller 21 with the printing medium is increased and thus the printing medium can be fed to the front side and the rear side with a high degree of accuracy without generating a slip.

Especially, in the printer apparatus 10 in accordance with the present invention, a clamp state is changed by exchanging the roller member 130 of the roller assembly 100 depending on, for example, material and/or thickness of a printing medium such as a sheet-like medium or a plate-like medium. As a result, printing media having various types of material/thickness such as a sheet-like medium and a plate-like medium are suitably clamped with a simple structure and are fed accurately.

A specific structure of the roller assembly 100 in the printer apparatus in accordance with the present invention will be described in detail below.

Further, a plurality of suction holes 13A is formed in the platen 13 and a decompression chamber (not shown) which is in communication with the suction holes 13A is provided on an under face of the platen 13. When printing is to be performed, for example, on a sheet-like medium "S", the sheet-like medium "S" is sucked and fixed to the upper face of the platen 13 by setting the decompression chamber in a negative pressure.

In the structure described above, when printing is to be performed on a sheet-like medium "S", in a state that the sheet-like medium "S" is sucked and fixed to the platen 13, "UV" ink is ejected and ultraviolet rays are irradiated while the printing unit 30 is moved in the right and left direction to perform printing. Then, suction of the sheet-like medium "S" to the platen 13 is released and, after the sheet-like medium "S" is fed by a predetermined distance to the front side, the sheet-like medium "S" is fixed to the platen 13 again and ejection of the "UV" ink and irradiation of the ultraviolet rays are performed. The operation is repeatedly performed to complete desired printing on the sheet-like medium "S".

In addition to the structure described above, in the printer apparatus 10, especially when printing is to be performing on a plate-like medium "B", a plurality of feeding auxiliary members 40 is provided in the platen 13 for feeding the plate-like medium "B" in the front and rear direction with a high degree of accuracy.

Further, when printing is to be performed on a plate-like medium "B" by using the printer apparatus 10 structured as described above, a rear side support base 60 is attached on the rear side of the printer apparatus 10 and a front side support base 70 is attached on the front side for supporting the plate-like medium "B" in a substantially horizontal state (see FIGS. 3 and 4). A structure of the rear side support base 60 will be described below with further reference to FIG. 4. A structure of the front side support base 70 is the same as that of the rear side support base 60 and thus its description is omitted.

As shown in FIG. 4, the rear side support base 60 is structured so that a feeding rail 61 whose length in the front and rear direction is about 1.2 m and on which a plurality of carrying rollers 62 is disposed in the front and rear direction is swingably supported by support legs 63. An inclination adjusting plate 64 is attached so as to connect the feeding rail 61 with the support leg 63 and the inclination adjusting plate 64 is swingably attached to the support leg 63. The inclination adjusting plate 64 is formed with an elongated hole 65. According to this structure, when a fixing screw 66 is inserted into the elongated hole 65 and is fastened to the feeding rail 61, the inclination adjusting plate 64 and the feeding rail 61 are fixed to each other and an inclination angle of the feeding rail 61 can be arbitrarily set with respect to the support leg 63.

For example, the feeding rail 61 may be fixed in a substantially horizontal state as shown in FIGS. 3 and 4, or the feeding rail 61 may be inclined downward and folded.

When the rear side support base 60 is not used, the rear side support base 60 can be stored in a compact folded state and thus saving of a storage space can be attained.

(Roller Assembly) Next, a specific structure of the roller assembly 100 in accordance with the present invention will be described below which is used in the printer apparatus 10 structured as described above.

Figure 5:
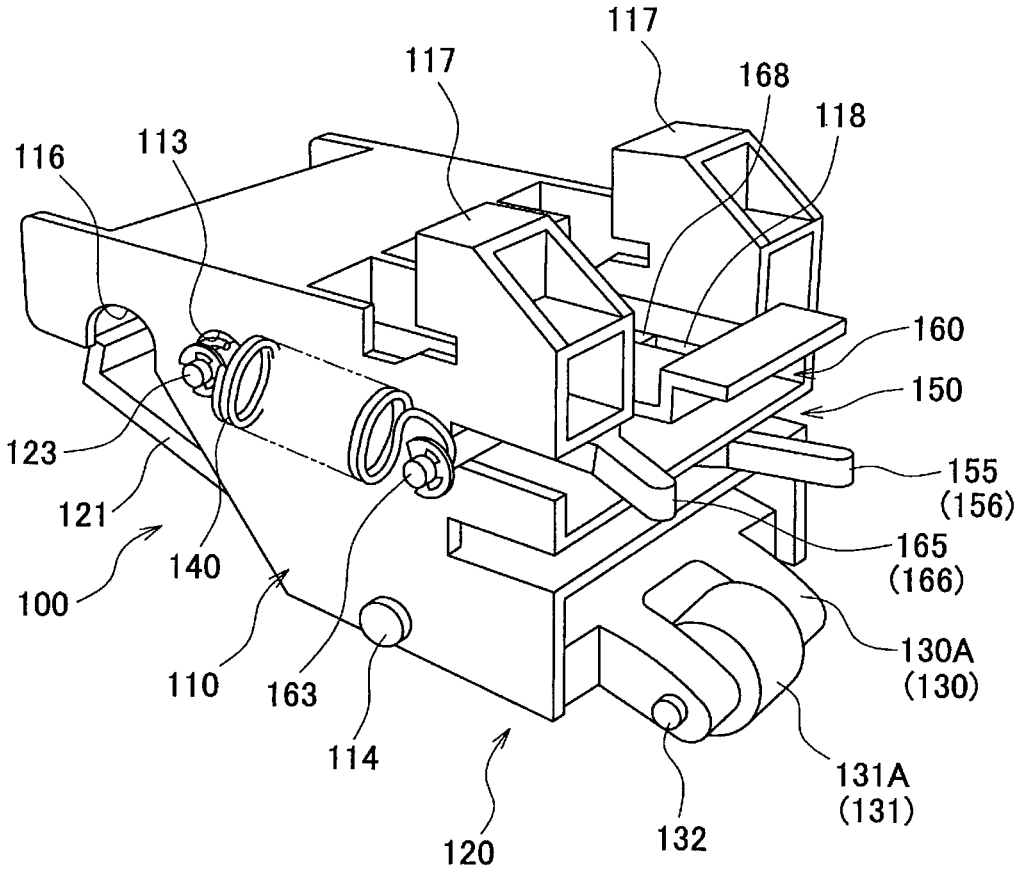
FIG. 5 is an outward appearance perspective view showing a roller assembly which is used in the printer apparatus in accordance with the present invention.
Figure 6:
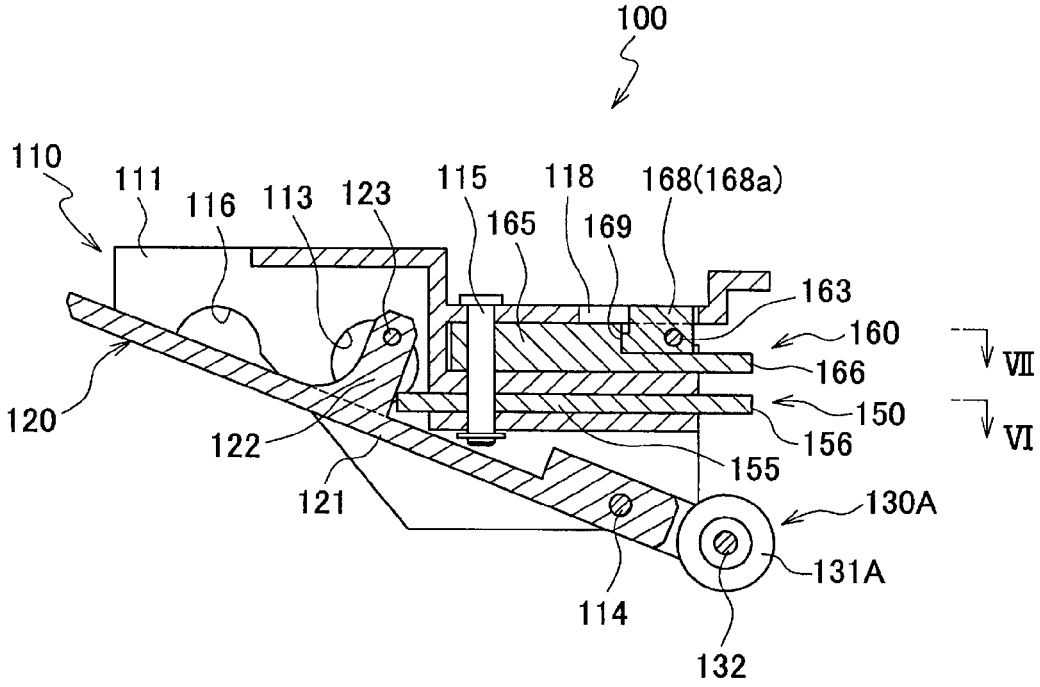
FIG. 6 is a cross-sectional side view showing the roller assembly.

FIGS. 5 and 6 are views showing an example of a structure of the roller assembly 100 in the printer apparatus 10 in accordance with the present invention. FIG. 5 is an outward appearance view and FIG. 6 is a cross-sectional side view at a center in the right and left direction.

The roller assembly is structured of an assembly case 110 which is a frame of the assembly, a clamp base 120 which is swingably supported in an upper and lower direction through a swing shaft 114 extending in the right and left direction at a lower part of the assembly case 110, a roller member 130A (130) which is attached to a front end part of the clamp base 120 and includes a rotatable pinch roller 131A (131), a pair of right and left coil springs 140 whose one end is engaged with a spring support shaft 123 on the clamp base side and the other end side is engaged with a spring support shaft 163 on the assembly case side so that the clamp base 120 supported by the swing shaft 114 is urged in a clockwise direction in FIG. 6 (direction moving the pinch roller 131 downward), a clamp engage and disengage mechanism 150 which includes levers 155 and 156 respectively protruding to the front face side of the assembly case 110 and switches ON/OFF of clamping of the roller assembly, a clamp pressure setting mechanism 160 for changing a clamp pressure, and the like.

A front portion of the assembly case 110 is, as shown in FIG. 6, partitioned into three portions with wall faces in the upper and lower direction. A lever (referred to as a clamp lever) 155 of the clamp engage and disengage mechanism 150 is pivotally attached by an lever shaft 115 extending in the upper and lower direction at a middle portion so as to be swingable in the right and left direction. Further, a lever (referred to as a clamp pressure setting lever) 165 of the clamp pressure setting mechanism 160 is also pivotally attached by the lever shaft 115 at an upper portion so as to be swingable in the right and left direction independently. A shaft engagement part 116 with which a support shaft supporting the roller assembly is engaged is formed on a rear side of the assembly case 110 and an upper part on the front side of the case is formed with a fixed flange part 117 which is formed with a screw insertion hole for fixing the roller assembly 100 at two positions in the right and left direction.

Figure 7:
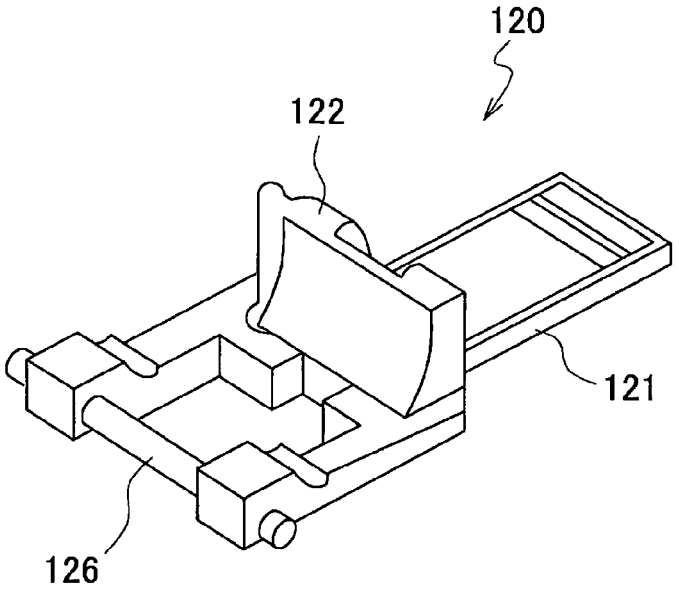
FIG. 7 is a perspective view showing a clamp base which is used in the roller assembly.

FIG. 7 is a view showing the clamp base 120. The clamp base 120 is, as shown in FIGS. 5 through 7, structured of a flat base plate part 121 extending in the front and rear direction which is swingably supported by a swing shaft 114 attached between right and left side walls of the assembly case 110, a lever engagement part 122 in a wall face shape which is protruded to an upper side from the base plate part 121 and is extended in parallel to the swing shaft 114, and a spring support shaft 123 which is pivotally supported by a support shaft hole which is penetrated in the right and left direction at an upper end of the lever engagement part 122.

The roller member 130 having the pinch roller 131 is provided at a tip end part of the base plate part 121 in an attachable/detachable manner.

Especially, in the present invention, the roller member 130 is selectively used depending on printing media having various types of material/thickness, in this embodiment, depending on a case that a printing medium is a sheet-like medium and a printing medium is a plate-like medium. As a result, suitable clamping can be performed depending on a printing medium and the printing medium is fed accurately.

Figure 8:
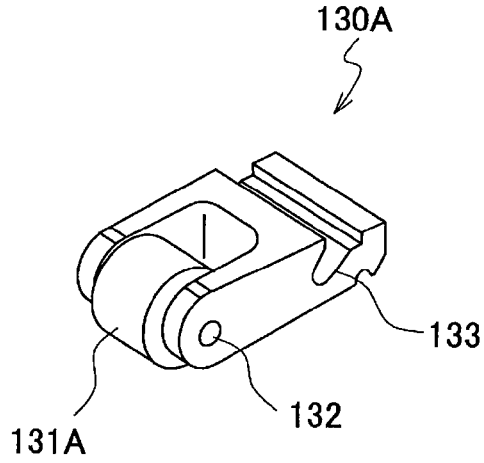
FIG. 8 is a perspective view showing an example of a roller member which is used when a printing medium is a sheet-like medium.
Figure 9:
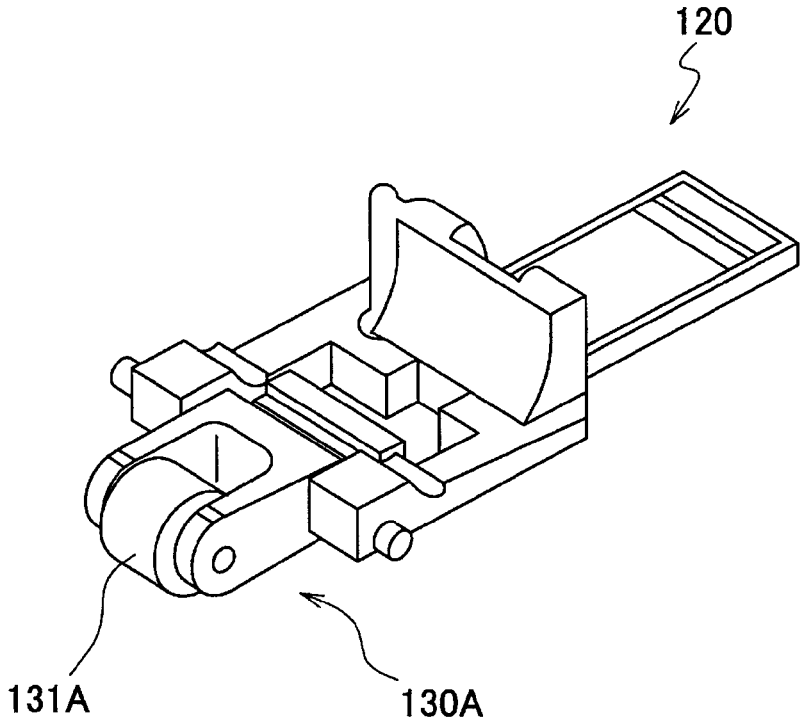
FIG. 9 is a perspective view showing a state where the roller member shown in FIG. 8 is attached to a clamp base.

FIG. 8 shows a roller member 130A which is used in a case that the printing medium is a sheet-like medium. FIG. 9 is a view showing a state where the roller member 130A is attached to the clamp base 120.

In a case that the printing medium is a sheet-like medium, the roller member 130A is provided with one pinch roller 131A having a relatively large diameter. The roller member 130A pivotally supports the pinch roller 131A so as to be rotatable by a roller pin 132.

When a recessed part 133 for attaching which is provided in the roller member 130A is fitted to a fixed shaft 126 of the clamp base 120, the roller member 130A is attached to a tip end part of the clamp base 120 without rattling.

In this case, for easily understood, the roller member 130 is described so as to be attached to the clamp base 120 separately. However, actually, the roller member 130 is attached to the clamp base 120 in a state that the clamp base 120 (structures an assembly main body) is supported by the assembly case 110.

In a case that a printing medium is a sheet-like medium (roll medium), the medium is fed at a high speed to perform printing and thus bearing at the time of feeding, in other words, stable feeding of a printing medium is more important than that a medium is firmly pressed like a plate-like medium described below.

When a printing medium is a sheet-like medium, the roller member 130A is provided with only one pinch roller 131A. Therefore, friction between the pinch roller 131A and a printing medium is small and the printing medium is fed stably.

Further, when a printing medium is a sheet-like medium, a thickness of the medium is thin and thus a diameter of the pinch roller 131A is relatively large according to the thickness of the medium in comparison with a plate-like medium (pinch roller 131 B).

Figure 10:
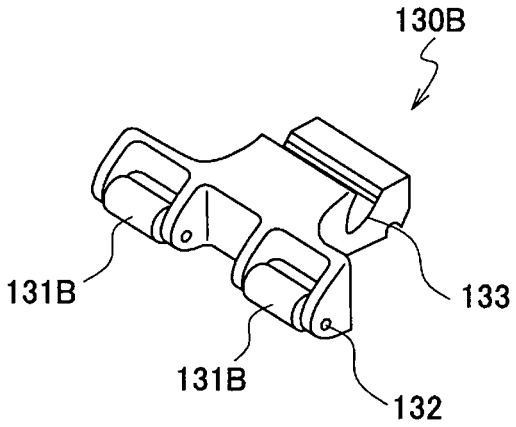
FIG. 10 is a perspective view showing an example of a roller member which is used when a printing medium is a plate-like medium.
Figure 11:
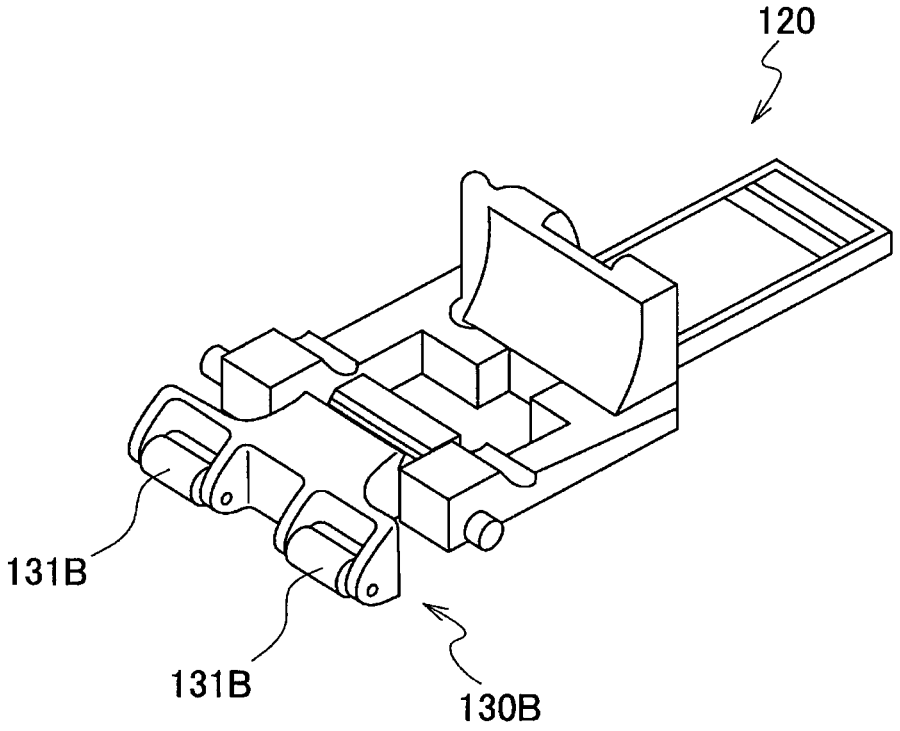
FIG. 11 is a perspective view showing a state where the roller member shown in FIG. 10 is attached to a clamp base.

FIG. 10 shows a roller member 130B which is used in a case that the printing medium is a plate-like medium. FIG. 11 is a view showing a state where the roller member 130B is attached to the clamp base 120.

In a case that the printing medium is a plate-like medium, the roller member 130B is provided with a plurality of pinch rollers 131B having a relatively small diameter which are disposed in a separated manner in the right and left direction. The roller member 130B pivotally supports the pinch roller 131B so as to be rotatable by the roller pin 132.

When a recessed part 133 for attaching which is provided in the roller member 130B is fitted to the fixed shaft 126 of the clamp base 120, the roller member 130B is attached to the tip end part of the clamp base 120 without rattling.

When a printing medium is a plate-like medium, the medium is not required to be fed at a high speed as in a case of a sheet-like medium (roll medium) and thus it is more important that a medium is firmly pressed than bearing at the time of feeding.

When a printing medium is a plate-like medium, since the roller member 130B is provided with a plurality of the pinch rollers 131B disposed in a separated manner, a pressing width is wide and thus the medium is pressed firmly. In this embodiment, the roller member 130B is provided with two pinch rollers 131B. However, the present invention is not limited to this embodiment and the roller member 130B may be, for example, provided with three or more pinch rollers.

When a printing medium is a plate-like medium, a thickness of the medium is thick and thus a diameter of the pinch roller 131B is relatively small according to the thickness of the medium in comparison with a case of a sheet-like medium (pinch roller 131A).

As described above, in the present invention, the roller members whose number of the pinch rollers/type of the pinch roller/clamping height (pinch roller diameter) is different from each other are selectively used depending on printing media having various types of material/thickness, i.e., in this embodiment, depending on a case that a printing medium is a sheet-like medium and a case that a printing medium is a plate-like medium. Therefore, clamping can be suitably performed corresponding to various types of printing medium with a simple structure and the printing medium can be fed accurately.

Further, in the roller assembly described above, right and left side walls of the assembly case 110 are formed with a support shaft insertion hole 113 through which the spring support shaft 123 is passed so as to be opened in accordance with a swing locus of the spring support shaft 123, and right and left end parts of the spring support shaft 123 are protruded to outer sides from the assembly case 110. An E-ring is fitted to the right and left end parts of the spring support shaft 123 so that the coil spring 140 engaged with the spring support shaft 123 is not easily disengaged.

The other end side of the coil spring 140 is engaged with the spring support shaft 163 which is inserted to a cam slider 168 of the clamp pressure setting mechanism 160. Therefore, the spring support shaft 123 is pulled by a spring force (tension) corresponding to a distance between the shafts, i.e., between the spring support shaft 123 on a clamp base side and the spring support shaft 163 on the assembly case side. As a result, the clamp base 120 supported by the swingable shaft 114 is urged in the clockwise direction in FIG. 6 (direction in which the pinch roller 131 is moved downward). An E-ring is also fitted to the right and left end parts of the spring support shaft 163 so that the coil spring 140 engaged with the spring support shaft 163 is not easily disengaged.

The clamp engage and disengage mechanism 150 is a clamp state setting mechanism which is capable of switching the clamp base 120 disposed so as to be urged as described above at a clamp position (clamp "ON") where the pinch roller 131 is pressed against the feed roller 21 to feed a printing medium and at a released position (clamp "OFF") where the pinch roller 131 is separated from the feed roller 21 to an upper side to release clamping of the printing medium.

Figure 12A:
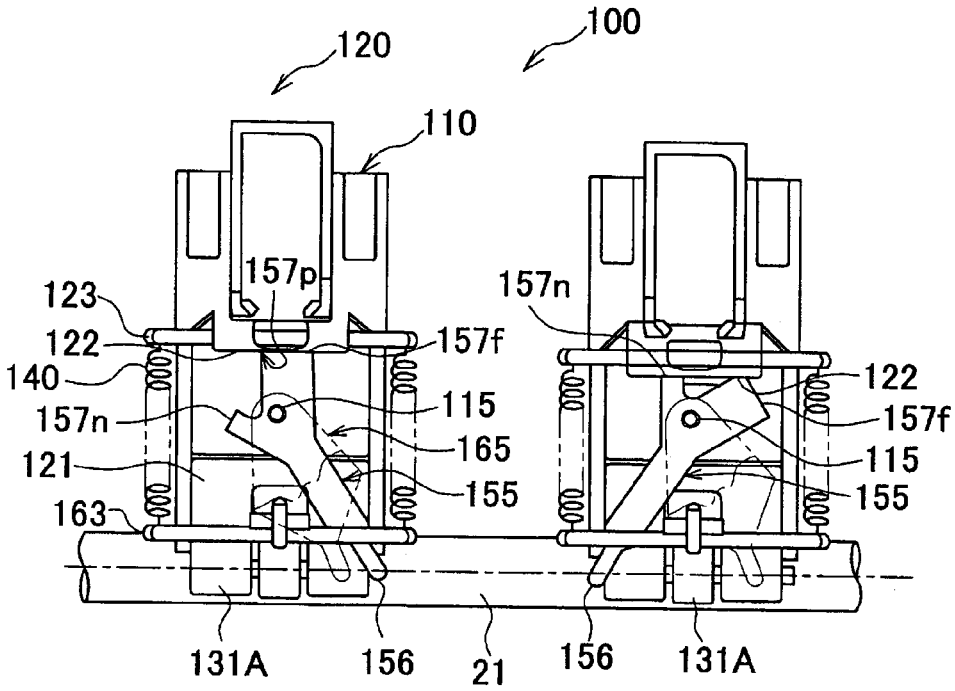
FIGS. 12(*a*) and 12(*b*) are explanatory views for explaining a structure and an operation of a clamp engage and disengage mechanism which is provided in the roller assembly.
Figure 12B:
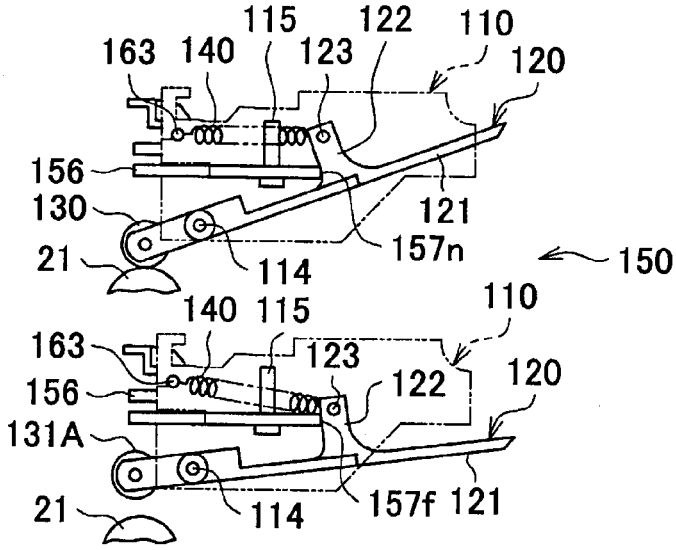

In order to describe the structure and operation of the clamp engage and disengage mechanism 150, FIGS. 12(*a*) and 12(*b*) show a clamp "ON" state where the clamp lever 155 is located at a right side swing angular position, thereby the roller assembly 100 is set at the clamp position, and a clamp "OFF" state where the clamp lever 155 is located at a left swing angular position, thereby the roller assembly 100 is set at the released position. FIG. 12(*a*) is a plan view which is viewed in the direction shown by the arrow "VI" in FIG. 6, and FIG. 12(*b*) is a side view which is viewed from the right side. In each of the drawings, in order to clearly indicate a relationship between an angular position of the clamp lever 155 and an angular position of the clamp base 120 which is swung by the clamp lever 155, the structures of respective parts of the assembly case 110, the clamp pressure setting mechanism 160 and the like are appropriately omitted. Further, in each of the drawings, an operation is shown in which the pinch roller 131A is used but an operation in which the pinch roller 131B is used is similarly performed.

The clamp engage and disengage mechanism 150 is mainly structured of a lever engagement part 122 of the clamp base 120 and the clamp lever 155.

The clamp lever 155 is formed in a plate-like shape extending in the front and rear direction so that the lever shaft 115 is located on its center side and the clamp lever 155 is pivotally supported by the assembly case so as to be swingable in the right and left direction with the lever shaft 115 as a swing center. A front end side of the clamp lever 155 extending to a front side from the lever shaft 115 is located on an upper side of the pinch roller 131 and is disposed so as to protrude to the front side of the assembly case 110 and the lever part 156 is formed so that a fingering operation can be performed. A rear end side of the clamp lever 155 is formed in a cam shape ("Y"-shaped cam in the embodiment shown in the drawing), in other words, an "OFF" engagement face 157*f* whose radius dimension from the lever shaft 115 is large is formed on the right side and an "ON" engagement face 157*n* whose radius dimension from the lever shaft 115 is small is formed on the left side.

When the clamp lever 155 is set at the "OFF" position on the right side, the "OFF" engagement face 157*f* is engaged with the lever engagement part 122 of the clamp base 120 to press the lever engagement part 122 to the rear side against an urging force of the coil spring 140 and the pinch roller 131 at the front end of the clamp base is held at the released position (clamp "OFF") where the pinch roller 131 is separated above the feed roller 21.

When the clamp lever 155 is set at the "ON" position on the left side, the "ON" engagement face 157*n* (and a left end corner part 157*p* of the "OFF" engagement face 157*f*) is capable of engaging with the lever engagement part 122 and the pinch roller 131 is held at the clamp position (clamp "ON") where the pinch roller 131 is pressed against a peripheral face (upper face) of the feed roller 21 by the urging force of the coil spring 140.

The clamp pressure setting mechanism 160 is a setting mechanism in the clamp state in which a pressing force of the pinch roller 131 is changed and set at the clamp position where the pinch roller 131 is pressed against the feed roller 21 so that a printing medium is sandwiched therebetween.

Figure 13A:
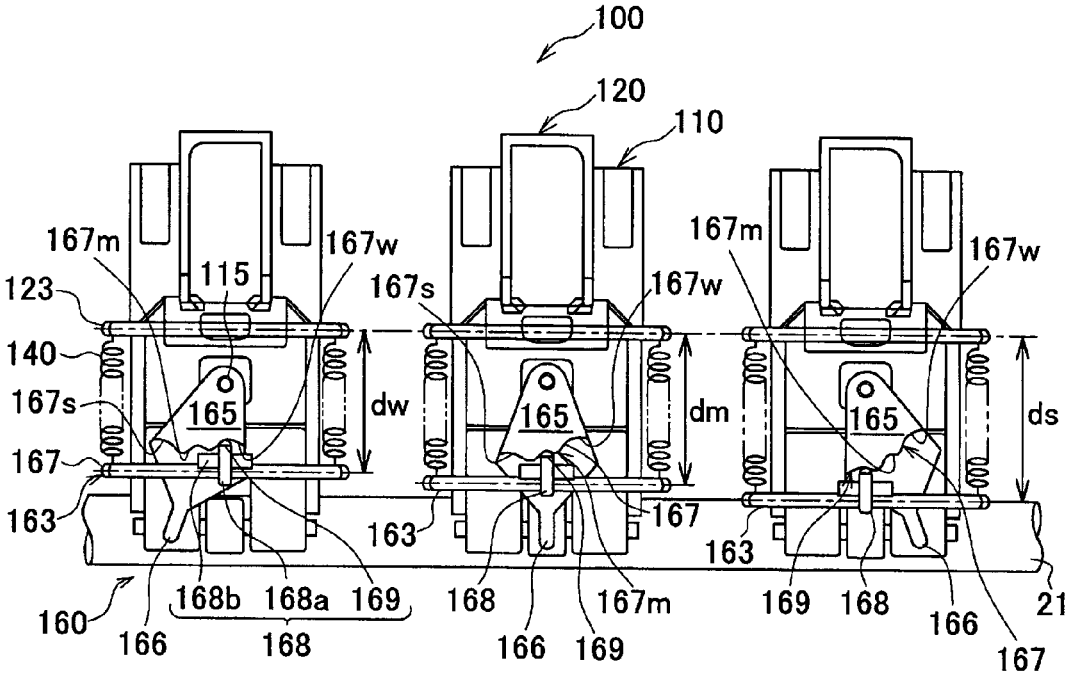
FIGS. 13(*a*) and 13(*b*) are explanatory views for explaining a structure and an operation of a clamp pressure setting mechanism which is provided in the roller assembly.
Figure 13B:
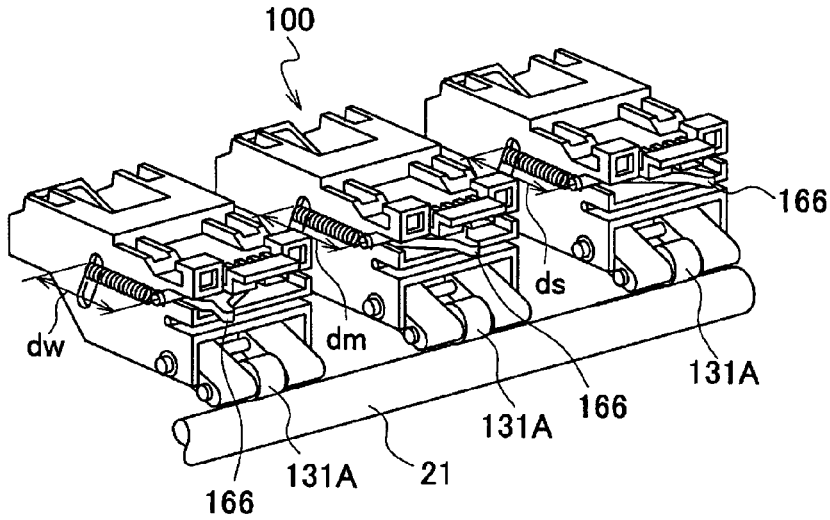

In order to describe the structure and operation of the clamp pressure setting mechanism 160, FIGS. 13(*a*) and 13(*b*) show a relationship between the clamp pressure setting lever 165 and setting conditions of the coil spring 140 when the clamp pressure setting mechanism 160 is changed at three levels of strong, medium and weak. FIG. 13(*a*) is s plan view which is viewed in the direction shown by the arrow "VII" in FIG. 6, and FIG. 13(*b*) is a perspective view showing the roller assemblies. Also in these drawings, in order to clearly indicate a relationship between an angular position of the clamp pressure setting lever 165 and a position of the spring support shaft 163 which is changed by the clamp pressure setting lever 165, the structures of respective parts of the assembly case 110, the clamp engage and disengage mechanism 150 and the like are appropriately omitted.

The clamp pressure setting lever 165 is formed in a rhombus shape in a plan view which is widened to the front side in a fan shape from the lever shaft 115 and then is narrowed in a taper shape. The clamp pressure setting lever 165 is located on an upper side of the clamp lever 155 of the clamp engage and disengage mechanism and is pivotally supported so as to be swingable in the right and left direction with the lever shaft 115 as a swing center. A front end side of the clamp pressure setting lever 165 is disposed so as to protrude to the front side of the assembly case 110 and a lever part 166 is formed so that a fingering operation can be performed. A base end side of the clamp pressure setting lever 165 is formed in a stepped shape which is thicker than the lever part 166 and a cam face 167 in a waveform in a plan view is formed on an erected face of the stepped part. The cam face 167 is formed with three engaging recessed parts for engaging with an engagement protruded part 169 of a tip end of the cam slider 168 to lock the cam slider 168. The three engaging recessed parts are, from the right side, a weak engagement recessed part 167*w* whose radius dimension from the lever shaft 115 is small, a medium engaging recessed part 167*m* whose radius dimension is medium, and a strong engagement recessed part 167*s* whose radius dimension is large.

The cam slider 168 which is engaged with the cam face 167 is provided with a body part 168*a* formed in a rectangular shape in a cross-sectional view which is longer in the front and rear direction, and a support part 168*b* which is protruded from the body part 168*a* in the right and left direction and is supported between an upper face of the clamp pressure setting lever and the assembly case 110. The spring support shaft 163 is inserted into a support shaft hole penetrating through the body part 168*a* in the right and left direction (see FIG. 5). A support shaft passing groove through which the spring support shaft 163 is passed is formed in the right and left side walls of the assembly case 110 so as to be opened to the front side. An upper wall of the assembly case 110 is formed with a slit-shaped slide groove 118 corresponding to a width of the body part 168*a* of the cam slider 168. An upper part of the body part is fitted to the slide groove 118 and the cam slider 168 is supported so as to be slidable only in the front and rear direction between the upper face of the clamp pressure setting lever 165 and the upper wall face of the assembly case 110 and is always urged to the rear side by the spring force of the coil spring 140 stretched over the spring support shafts 123 and 163 (see FIGS. 5 and 6). A rear end of the body part 168 is formed with an engaging protruded part 169 formed in a circular arc shape in a plan view and the engaging protruded part 169 is engaged with the cam face 167 of the clamp pressure setting lever to be stably supported by the three engaging recessed parts 167*w*, 167*m* and 167*s* formed in the cam face.

Therefore, when the clamp pressure setting lever 165 is swung in the right and left direction against the spring force of the coil spring 140, the engaging protruded part 169 engaged with the cam face 167 of the clamp pressure setting lever is slid and moved on the cam face in the front and rear direction. Accordingly, the clamp pressure setting lever 165 is locked and held at an angular position where the clamp pressure setting lever 165 is engaged with either of three engaging recessed parts 167*w*, 167*m* and 167*s* formed on the cam face 167.

The radius dimensions of the three engaging recessed parts 167*w*, 167*m* and 167*s* from the lever shaft 115 are different from each other as described above, and their dimensions in the radial direction are set to be as the weak engagement recessed part 167*w*<the medium engaging recessed part 167*m*<the strong engagement recessed part 167*s*. Therefore, when the engaging protruded part 169 is engaged with and held by each of the engaging recessed parts, the position of the spring support shaft 163 is varied in the front and rear direction and thus a setting length "d" of the coil spring 140 stretched over the spring support shafts 123 and 163 is varied. In other words, in a case that a setting length is set to be "dw" when the clamp pressure setting lever 165 is swung to the left side and the engaging protruded part 169 is engaged with and held by the weak engagement recessed part 167*w*, the setting length is set to be "dm" when the clamp pressure setting lever 165 is located at the center position and the engaging protruded part 169 is engaged with and held by the medium engaging recessed part 167*m*, and the setting length is set to be "ds" when the swing clamp pressure setting lever 165 is swung to the right side and the engaging protruded part 169 is engaged with and held by the strong engagement recessed part 167*s*, the relationship is set as "dw<dm<ds". As a result, a spring force corresponding to the setting length, in other words, a pressing force (clamp pressure) by which the pinch roller 131 is pressed against the feed roller 21 is varied in three levels of "weak", "medium" and "strong" depending on the setting length.

As described above, in the clamp pressure setting mechanism 160, the clamp pressure setting lever 165 is swung in the right and left direction so that the engaging protruded part 169 is engaged with and held by either of the engaging recessed parts 167*w*, 167*m* and 167*s* and thus, the clamp pressure can be varied and set in three levels of "weak", "medium" and "strong".

As described above, in the printer apparatus and the roller assembly in accordance with the present invention, the roller members whose number of the pinch rollers/type of the pinch roller/clamp height (pinch roller diameter) is different from each other are selectively used depending on printing media having various types of material/thickness, i.e., in accordance with an embodiment of the present invention, depending on a case that a printing medium is a sheet-like medium and a case that a printing medium is a plate-like medium. Therefore, according to the present invention, clamping can be suitably performed corresponding to various types of printing medium with a simple structure and the printing medium can be fed accurately.

Although the present invention has been shown and described with reference to a specific embodiment, the technical scope of the present invention is not limited to the embodiment described above.

For example, in the embodiment described above, printing is performed by using "UV" ink. However, the present invention may be also applied to a printer apparatus in which, for example, water-based ink, oil-based ink, solvent ink or the like is used.

Further, in the embodiment described above, different roller members are used for a sheet-like printing medium and for a plate-like printing medium. However, the present invention is not limited to this embodiment. Different roller members may be used for a sheet-like printing medium depending on its material/thickness. Further, different roller members may be used for a plate-like printing medium depending on its material/thickness.

INDUSTRIAL APPLICABILITY

The present invention may be widely applied to a printer apparatus in which printing is performed on a printing medium by ejecting ink from a printer head.

The invention claimed is:

1. A printer apparatus in which printing is performed on a printing medium by ejecting ink while a printer head is relatively moved in a feeding direction and a scanning direction perpendicular to each other in a faced state with respect to the printing medium supported by a medium support means for supporting the printing medium, comprising:

a feeding mechanism which includes a feed roller that is extended in a right and left direction at a height position same as an upper face of the medium support means and is rotationally driven, and a plurality of roller assemblies in which rotatable pinch rollers are juxtaposedly disposed in the right and left direction on an upper side of the feed roller, and the feeding mechanism pinching the printing medium placed on the medium support means between the feed roller and the pinch rollers to feed the printing medium in a front and rear direction;

a head moving mechanism for moving the printer head in the scanning direction; and a print control section for executing feed control of the printing medium by the medium feeding mechanism and movement control of the printer head by the head moving mechanism;

wherein the roller assembly comprises:

an assembly case, which is a frame of the assembly;

a clamp base, which is swingably supported through a swing shaft of the assembly case; and a roller member which includes the rotatable pinch roller and is attachable/detachable with respect to the clamp base;

wherein when the roller member is attached to the clamp base, the clamp base is swingably supported through the assembly case such that pinch roller of the pinch member of the clamp base is capable of switched between a position where the pinch roller and the printing medium are in contact and another position where the pinch roller and the printing medium are separated, the roller member and the clamp base are in an integrated manner such that the roller member is swingable, and a clamp state can be changed by attaching the roller member which is selected from a plurality of roller members to the clamp base depending on material and/or thickness of the printing medium.

2. The printer apparatus according to claim 1, wherein, in a case that the printing medium is a sheet-like medium, the roller member includes one pinch roller.

3. The printer apparatus according to claim 1, wherein, in a case that the printing medium is a plate-like medium, the roller member includes a plurality of the pinch rollers having a relatively small diameter compared with a case that the printing medium is a sheet-like medium and disposed in a separated manner in the right and left direction.

4. A roller assembly which is used in a printer apparatus in which printing is performed on a printing medium by ejecting ink while a printer head is relatively moved in a feeding direction and a scanning direction perpendicular to each other in a faced state with respect to the printing medium supported by a medium support means for supporting the printing medium, comprising:

an assembly case which is a frame of the assembly;

a clamp base, which is swingably supported through a swing shaft of the assembly case; and a roller member which includes a rotatable pinch roller and is attachable/detachable with respect to the clamp base;

wherein when the roller member is attached to the clamp base, the clamp base is swingably supported through the assembly case such that pinch roller of the pinch member of the clamp base is capable of switched between a position where the pinch roller and the printing medium are in contact and another position where the pinch roller and the printing medium are separated, the roller member and the clamp base are in an integrated manner such that the roller member is swingable, and a clamp state can be changed by attaching the roller member which is selected from a plurality of roller members to the clamp base depending on material and/or thickness of the printing medium.

5. The roller assembly according to claim 4, wherein, in a case that the printing medium is a sheet-like medium, the roller member includes one pinch roller.

6. The roller assembly according to claim 4, wherein, in a case that the printing medium is a plate-like medium, the roller member includes a plurality of the pinch rollers having a relatively small diameter compared with a case that the printing medium is a sheet-like medium and disposed in a separated manner in the right and left direction.

* * * * *